6/26/84 XR SR 4,455,801

United States Patent [19]

Merritt

[11] 4,455,801

[45] Jun. 26, 1984

[54] LIGHT WEIGHT VAULT WALL

[75] Inventor: W. R. Merritt, Nepean, Canada

[73] Assignee: Canadian Patents & Development Limited, Ottawa, Canada

[21] Appl. No.: 403,001

[22] Filed: Jul. 29, 1982

[51] Int. Cl.[3] ..... E04B 2/02; E04H 3/08

[52] U.S. Cl. ..... 52/309.9; 52/232; 52/265; 52/463; 109/84

[58] Field of Search ..... 52/309.5, 309.9, 459, 52/470, 474, 475, 232, 106, 265; 109/58, 78, 79, 83, 84; 428/247, 256, 319.1

[56] References Cited

U.S. PATENT DOCUMENTS

| | | | |
|---|---|---|---|
| 1,548,441 | 8/1925 | Branovich | 109/84 X |
| 1,669,486 | 5/1928 | Pyle | 109/84 X |
| 2,156,347 | 5/1939 | McLaughlin, Jr. | 52/463 |
| 2,728,702 | 12/1955 | Simon et al. | 52/309.5 X |
| 2,787,345 | 4/1957 | Soubier et al. | 52/232 |
| 2,962,133 | 11/1960 | Kivett et al. | 52/463 X |
| 3,040,118 | 6/1962 | Schaller, Jr. | 52/463 X |
| 3,496,058 | 2/1970 | Schroter et al. | 52/309.5 X |
| 3,507,738 | 4/1970 | Prusinski et al. | 52/309.9 X |
| 3,708,380 | 1/1973 | Niebylski | 428/319.1 X |
| 4,075,804 | 2/1978 | Zimmerman | 52/232 |
| 4,323,000 | 4/1982 | Dennis et al. | 109/84 X |

*Primary Examiner*—Alfred C. Perham
*Attorney, Agent, or Firm*—Robert G. Hendry

[57] ABSTRACT

A light weight composite panel for use in vaults or strong rooms, having a foamed plastic core, metal mesh embedded in the major faces of the core, a layer of wood on each face of the plastic core, and a sheet metal skin covering the layers of wood. An inner one of the sheet metal skins is preferably a heat conductive metal, such as aluminum.

6 Claims, 4 Drawing Figures

LIGHT WEIGHT VAULT WALL

This invention relates to security structures such as strong rooms or vaults and more particularly, to panels for use in walls or doors of such structures.

Traditional vaults have provided higher security by using a greater thickness and density of materials. However, the structural loads inherent in such vaults exceed the normal live load limits of floors designed for the usual office accommodations. Thus vaults of this type are accommodated in the basement or ground floor levels of buildings where floor loadings are adequate.

It is therefore desirable to develop security structures fabricated of lightweight materials having comparable attack resistance which are capable of being erected on office floors having a live load bearing capacity of approximately 50 lb. per square foot.

This attack resistance of the proposed vault relates to the time required to gain access and is obtained by the selection and arrangement of materials which will interfere with the operation of power tools. Furthermore, a number of tools will be required to penetrate the structure because of the variety of materials used.

It is therefore an object of this invention to provide a wall panel for a vault which is lighter in weight than conventional vaults walls.

Another object of this invention is the provision of a panel for a vault wall having attack resistance comparable to that of conventional vaults.

A further object of the present invention is the provision of a vault which can be dismantled and moved to another location.

Accordingly, the present invention provides a foamed polymeric resin capable of bonding with power tools and producing noxious fumes when burned; metal mesh embedded in said polymeric resin on at least one major face; wood panels on each major face of said polymeric resin; a heat conductive metal on a covering face of said wall structure; and sheet metal covering a second major face of said structure.

In the accompanying drawings which illustrate a preferred embodiment of this invention:

Figure 1:
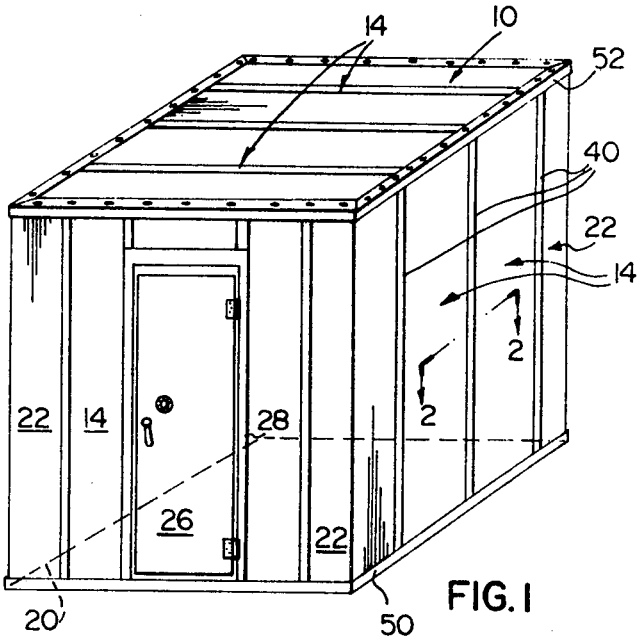
FIG. 1 is a perspective view of a strong room vault.

Referring now in detail to the drawings, a vault shown generally at 10 in FIG. 1, comprises a plurality of panels 14 forming the walls 16, ceiling 18, and a floor 20. Corners of the vault 10 are formed by panels having a substantially L-shaped cross section.

A suitable door 26 and door frame 28, for the vault 10, will be described in a separate patent application.

Figure 2:
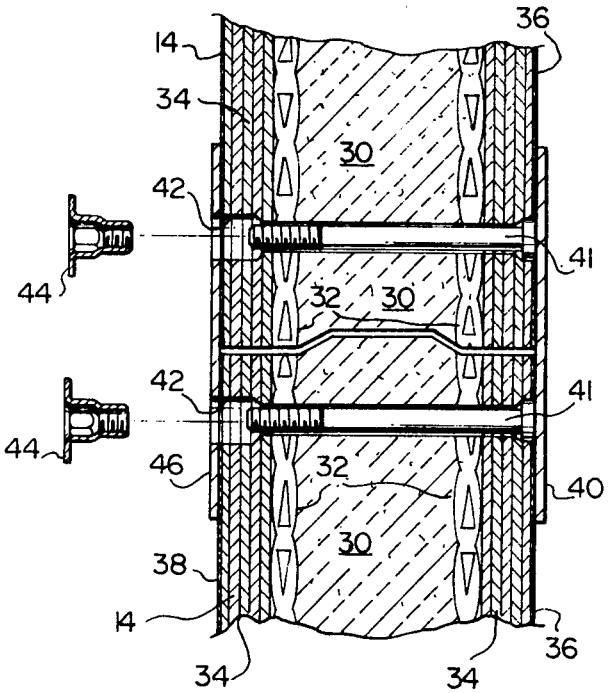
FIG. 2 is a cross sectional view of adjoining panels of the vault taken along the line 2—2 of FIG. 1.

As shown in detail in FIG. 2, the panels 14 and 22 comprise a foamed plastic core 30, such as urethane, capable of producing noxious fumes. Expanded metal mesh 32 is embedded in both major faces of the plastic core and heavy plywood, particleboard or the like, 34 covers the metal mesh on both faces. In addition, a thin sheet of stainless steel 36 is adhesively secured to an outer face of the plywood 34. An stucco embossed aluminum sheet 38 is adhesively secured to the face of the panel which will be on the inside of the vault 10.

Vertical joints between the panels 14, or 14 and 22, are covered by joint covers 40. Bolts 41, having their heads welded to the joint cover 40, pass through suitable apertures 42 adjacent the mating ends of the panels 14 or 22. The apertures 42 are countersunk to receive recessed nuts 44 which also pass through pairs of apertures in an aluminum strip 46 to engage pairs of bolts 41 on the joint cover 40.

Figure 3:
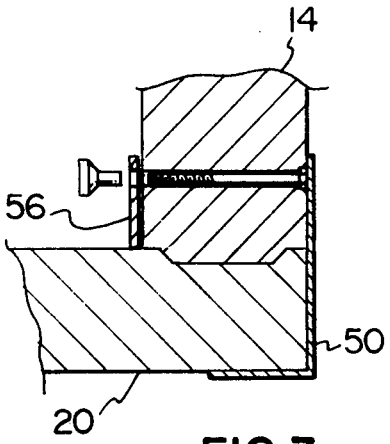
FIG. 3 is an end elevational view of a bottom joint cover including floor and wall panels shown in broken lines.
Figure 4:
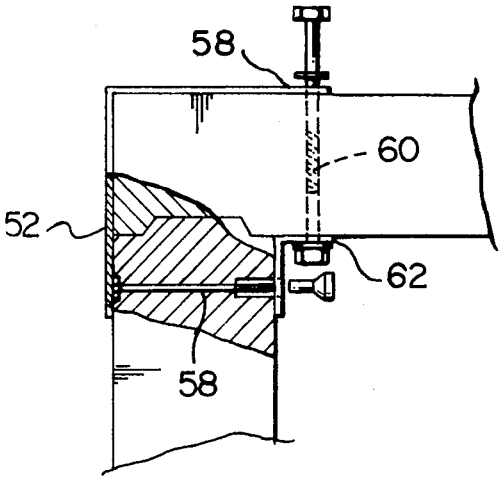
FIG. 4 is an end elevational view of a ceiling joint cover.

The joint covers 50 and 52, shown in more detail in FIGS. 3 and 4, are bolted through the panels 14 and 22 in much the same manner as the vertical joint cover 40. The cover 50, for use on floor panels, has a right angle bend to extend under the floor 20 and a bolt, the head of which is welded to the upright portion of the cover is adapted to extend through the wall panel 14 and through an aluminum angle bracket 56.

The wall panel 10 is preferably assembled so as to have the stainless steel sheet glued to the smooth side of the plywood sheet through the use of a water dispersed adhesive. The layer of expanded metal mesh 32 is attached to the rough side of the plywood with metal staples prior to the plywood being glued to the stainless steel. The aluminum sheet is stucco embossed and is adhesively secured to the second plywood sheet as described with reference to the stainless steel sheet.

The foamed plastic core is preferably rigid urethane which is foamed in place at a pressure of approximately 60 psi, so as to bond tenaciously to the interior and exterior layers of plywood. The expanding agent used in the core 30 is Freon 11 having an inherent pressure of 38 psi at a temperature of 150° F. The U factor of the urethane foam is not in excess of 0.029. The rigid foam 30 is designed to be stable at temperatures ranging from −90° F. to +250° F. The panel edges are provided with the tongue and groove edges to assure airtight vapourproof joints. A flexible vinyl gasket may be fitted on the interior and exterior of each panel along every tongue edge to provide sealing at each joint.

I claim:

1. A strong wall for delaying unauthorized access to the interior of a vault or other structure constructed of said strong walls, said strong walls comprising:

a foamed polymeric resin core capable of bonding with power tools and producing noxious fumes when burned, said core having inner and outer major faces, expanded metal mesh embedded in at least an outer face of said core, inner and outer wood panels covering both faces of said core, a heat conductive metal sheet covering the inner wood panel, and a metal sheet covering said outer wood panel.

2. A strong wall structure as claimed in claim 1 wherein said foamed polymeric resin is polyurethane.

3. A strong wall structure as claimed in claim 1 wherein said wood panels comprise plywood.

4. A strong wall structure as claimed in claim 1 wherein said heat conductive material is aluminum.

5. A strong wall as claimed in claim 1 wherein said metal sheet on said wood panel is stainless steel.

6. A strong wall structure as claimed in claim 1 wherein joints between panels are covered by metal strips bolted to adjoining panels by bolts having their heads welded to the inner faces of the strips and their other ends secured to metal strips on the inner face of the wall so as to cover said joint.

* * * * *